US006688210B2

(12) United States Patent
Bubits

(10) Patent No.: US 6,688,210 B2
(45) Date of Patent: Feb. 10, 2004

(54) PISTOL WITH A FIRING BOLT FIRING MECHANISM

(76) Inventor: Wilhelm Bubits, Franz Anderle Platz 3/4/6, A-2345 Brunn, Gebirge (AT)

( * ) Notice: Subject to any disclaimer, the term of this patent is extended or adjusted under 35 U.S.C. 154(b) by 0 days.

(21) Appl. No.: 10/371,796

(22) Filed: Feb. 21, 2003

(65) Prior Publication Data

US 2003/0183069 A1 Oct. 2, 2003

(30) Foreign Application Priority Data

Mar. 27, 2002 (AT) ..... A 487/2002
Jul. 1, 2002 (AT) ..... A 982/2002

(51) Int. Cl.[7] ..... F41A 5/00

(52) U.S. Cl. ..... 89/147; 89/132; 89/27.11; 42/69.01

(58) Field of Search ..... 89/147, 132, 27.11; 42/69.01, 69.02, 69.03

(56) References Cited

U.S. PATENT DOCUMENTS 1,271,678 A * 7/1918 Diehm ..... 89/148
3,755,947 A * 9/1973 Koon, Jr. ..... 42/16
4,126,079 A * 11/1978 Perrine ..... 89/190
4,589,327 A * 5/1986 Smith ..... 89/148
5,109,622 A * 5/1992 Echeberria ..... 42/69.02
5,412,894 A * 5/1995 Moon ..... 42/69.02

* cited by examiner

*Primary Examiner*—Michael J. Carone
*Assistant Examiner*—M. Thomson
(74) *Attorney, Agent, or Firm*—Bachman & LaPointe, P.C.

(57) ABSTRACT

A pistol comprises a basic housing (1) and a barrel slide (2) which is guided movably on the basic housing (1). An insert piece (8) is mounted in the barrel slide and contains a firing pin (20) and a firing spring (33). In order to improve the reliability while at the same time reducing the production costs, the insert piece (8) forms an open internal cavity (15) in which there are guide surfaces (16, 17, 18) for the firing bolt (20). The firing bolt (20) has mating surfaces (26, 27, 28), which rest on the guide surfaces (16, 17, 18) of the cavity (15) and, on its upper face, defines a free space (24) which runs in a longitudinal direction. The free space (24) contains the firing spring (33), whose front end (34) is supported on the firing pin (20) and whose rear end (35) is supported on an opposing bearing (14).

10 Claims, 2 Drawing Sheets

PISTOL WITH A FIRING BOLT FIRING MECHANISM

BACKGROUND OF THE INVENTION

The invention relates to a pistol comprising a basic housing and a barrel slide which is guided movably on the basic housing, the barrel slide, in cross section, comprises two side walls and a cover wall connecting the side walls to define an interior space, in the interior space of the barrel slide receives a barrel at the front of the space and behind the barrel an insert piece is mounted, the insert piece contains a firing bolt and a firing spring.

In order to distinguish them from pistols with a hammer firing mechanism, in pistols with a firing bolt mechanism, the impact energy which is required to fire the shot is applied to the firing bolt by a firing spring which is accommodated in the interior of the barrel slide. The spatial conditions relating to the configuration of the firing bolt and firing spring are correspondingly narrow.

In the known configurations of the assembly formed by the firing bolt/firing spring, the two parts are concentric, with the spring either surrounding the firing bolt or the spring being accommodated in a bolt which widens at the rear like a case, and the entire assembly is inserted from the rear into a long longitudinal hole in the insert piece.

These designs first of all have the disadvantage that said assembly is composed of very complicated parts which require a very large amount of effort to manufacture and assemble. Owing to the small available diameter, the firing spring is too thin, kinks somewhat and rubs against the edge surfaces, either of the case or of the hole in the insert piece, which has no smooth wall through its length (provided it is not subject to costly reworking internally). Since the hole is drilled into the insert piece from the rear, the mounting of the assembly in the insert piece and of the insert piece in the barrel slide is delicate with regard to kicking when firing. Its life is limited.

Furthermore, the available physical length of the assembly, in particular of the firing spring, restricts the spring force, and hence also the firing force. This can lead to firing malfunctions. This problem will occur to an ever greater extent in the future due to the ever increasing use, for legal reasons, of primer cups with only small amounts of hazardous substances, but which require greater firing energy.

The object of the invention is to overcome the above disadvantages and to design an assembly comprising the insert piece/firing bolt/firing spring such that the pistol operates more reliably and with less wear, while the total production costs are as low as possible.

SUMMARY OF THE INVENTION

According to the invention, the object is achieved wherein a) the insert piece forms an internal cavity which is open on a side facing the cover wall of the barrel slide, guide surfaces are provided for the firing bolt on the internal cavity, b) the firing bolt has mating surfaces which rest on the guide surfaces of the internal cavity to define a free space which runs in a longitudinal direction between the firing bolt and the cover wall on the side facing the cover wall of the barrel slide, and c) the free space contains the firing spring which has front end supported on the firing bolt and a rear end supported on an opposing bearing.

The insert piece is easy to machine (no more deep hole!) and, internally, offers a large amount of space for the firing bolt and firing spring, which are simple to insert into the cavity from above before the installation of the insert piece. The insert piece is in the form of a trough, whose rear wall can be connected to the barrel slide such that it is resistant to kicking, thus improving the life. The guide surfaces may be simple surfaces, thus allowing clean guidance with little manufacturing effort.

The recess on the upper face of the firing bolt for holding the firing spring does not need to be concentric with respect to the tip of the firing bolt, once again thanks to the good guidance in the insert piece. The end walls which bound the recess at the front and rear can be very far apart from one another, so that there is also more space in the longitudinal direction for the firing spring. The spring can thus not only be designed to be stronger, but its movement is also less impeded.

The cross section of the firing bolt, and hence also the cross section of the free space, may be designed very freely for the purposes of the invention. In the extreme, it is so broad that the free space is bounded at the sides only by the longitudinal walls of the insert piece. In another embodiment, the recess is a longitudinal groove which is open at the top. In both cases, despite its generally eccentric position, the spring is surrounded on all sides by surfaces, but with an adequate gap. Both the longitudinal wall of the insert piece and the groove can be machined easily and cheaply with high accuracy, for example by milling.

In one preferred embodiment, the guide surfaces in the insert piece and the mating surfaces of the firing bolt form the three sides of a rectangle. In consequence, the entire firing bolt is a body which has a cuboid basic shape and can thus be machined easily and accurately. Furthermore, the firing bolt is thus secured against rotation, and its mass, and hence the possible firing energy, can be increased.

In a further refinement, the inner wall of the box-shaped insert piece forms the opposing bearing for the rear end of the firing spring and rests on the rear end of the barrel slide. The former measure means that there is no need for a separate opposing bearing or a screw connection for the assembly. The latter improves the kicking resistance and hence the life.

In one preferred embodiment, the insert piece is connected to the barrel slide at two points by means of horizontal pins or the like, which pins pass through the entire width of the barrel slide. In particular, the pin can pass through the rear wall of the insert piece at the rear connecting point. These measures result in a connection which is detachable but nonetheless firm, and which withstands the kicking that occurs during operation particularly well.

In a further development of the idea of the invention, the rear wall of the insert piece has a transverse groove for the insertion of the rear sight, for which purpose it is thickened in its upper part in the longitudinal direction of the pistol. Finally, the rear sight can even be integrally formed with the rear wall, on the rear wall of the insert piece. In consequence, the rear sight can be arranged very deep with respect to the barrel axis, which simplifies aiming and helps to achieve better hit results. Furthermore, this further reduces the production costs and the number of parts.

BRIEF DESCRIPTION OF THE DRAWINGS

The invention will be described and explained in the following text with reference to figures, in which.

DETAILED DESCRIPTION

Figure 1:
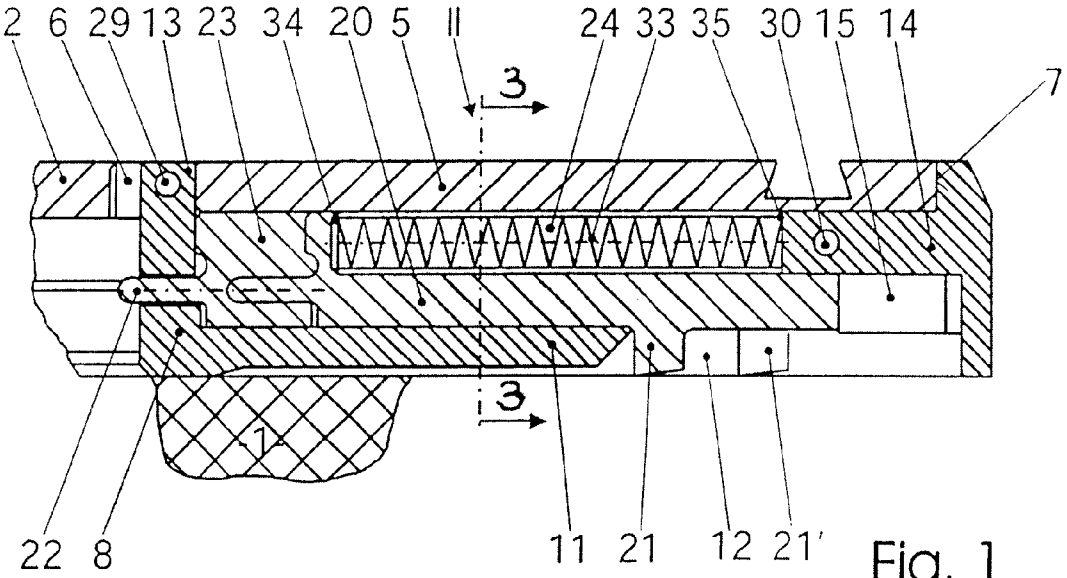
FIG. 1 shows a partial longitudinal section through a pistol according to the invention.
Figure 2:
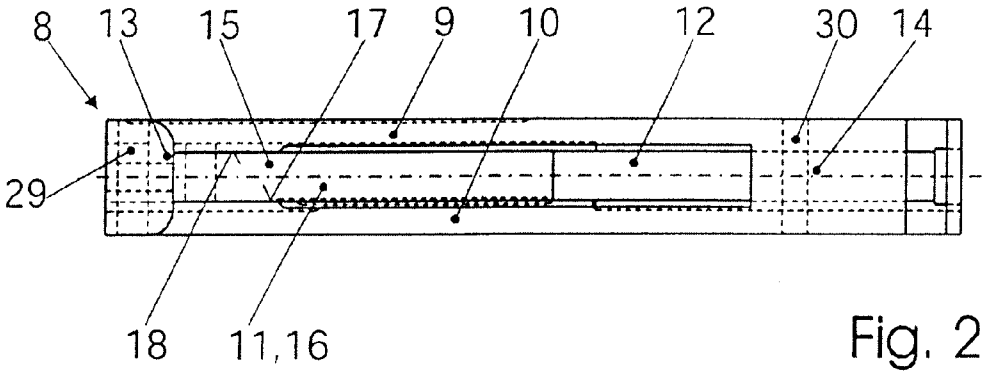
FIG. 2 shows a plan view corresponding to II in FIG. 1.

The basic housing 1 is only indicated in FIG. 1. A barrel slide 2 is guided on this basic housing 1, such that it can move, in a known manner. Only its rear part can be seen, its cross section (FIG. 3) is approximately U-shaped and comprises two side walls 3, 4 and a cover wall 5 between them. The cover wall 5 of the barrel slide 2 has an aperture 6 approximately in the center of its length, and ends at an end surface 7 at the rear.

An insert piece 8 is mounted internally in the rear part of the barrel slide 2. This is in the form of a trough and has two side walls 9, 10, a bottom 11 with a slot 12, an end wall 13 at the front, and, at the rear, a rear wall which forms an opposing bearing 14. A high space 15 is thus formed in the interior of the insert piece 8, which has guide surfaces 16, 17 and 18 whose cross sections (see FIG. 3 and even better FIG. 4) form the three sides of a rectangle. The insert piece 8 is firmly connected to the barrel slide 2 by means of shear pins 29, 30. The pins 29, 30 or the like pass through the side walls 3, 4 of the barrel slide and the end wall 13 and/or the rear wall 14 of the insert piece 8. The two shear pins 29, 30 are a long distance apart from one another and are used for mounting the insert piece 8 in the barrel slide 2. This mounting and the fact that the rear wall 14 rests on the end surface 7 of the barrel slide 2 result in a longlife connection which is resistant to kicking.

A firing bolt 20 is arranged in the cavity 15 in the insert piece 8 such that it can be moved in the longitudinal direction. This is an approximately cuboid body which has the actual firing pin 22 at the front and, at the rear, a lug 21 which projects downward through the slot 12 and interacts with a trigger apparatus, which is not shown. The firing bolt 20 has mating surfaces 26, 27, 28 which, together with the guide surfaces 16, 17, 18 of the insert piece 8, form a precise longitudinal guide. Furthermore, in its front part, the firing bolt 20 has a shoulder 23 which is open at the rear and from which a free space 24 is formed up to the rear end of the firing bolt 20. Here, this free space 24 is bounded at the side by the side walls 9, 10 of the insert piece 8, underneath by the body of the firing bolt 20, and on top by the cover wall 5 of the barrel slide 2. At the rear, it extends as far as the opposing bearing 14.

A firing spring 33 is accommodated in this free space, which is rectangular in the illustrated exemplary embodiment. Its front end 34 is supported on the shoulder 23, and its rear end 35 is supported on the opposing bearing 14. FIG. 1 shows how much space is available in the design according to the invention for accommodating a generously designed firing spring 33.

Figure 3:
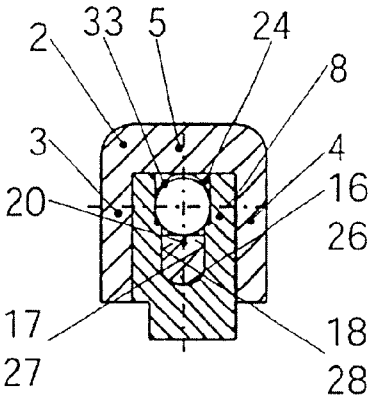
FIG. 3 shows a cross section along 3—3 in FIG. 1.
Figure 4:
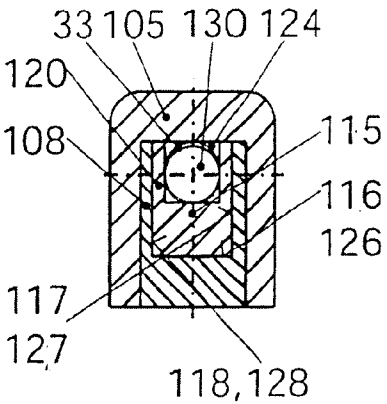
FIG. 4 shows a view as in FIG. 3, but in a variant.

The variant shown in FIG. 4 differs from that shown in FIG. 3 in that the insert piece 108 has a larger cavity 115 for accommodating a more bulky firing bolt 20. This firing bolt fills the entire height of the insert piece 8 approximately as far as the cover wall 105. In this case, the free space for the firing spring 23 is a groove 130, which is milled into the firing bolt. Simple parts which are easy to manufacture are used in both variants. The assembly process is also simple. The firing bolt and firing spring are inserted into the insert piece, the insert piece is then inserted from underneath into the barrel slide, and is secured by means of the shear pins.

Figure 6:
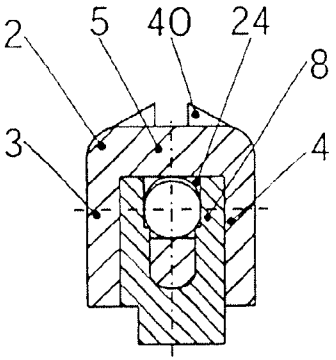
FIG. 6 shows a cross section along 6—6 in FIG. 5.
Figure 5:
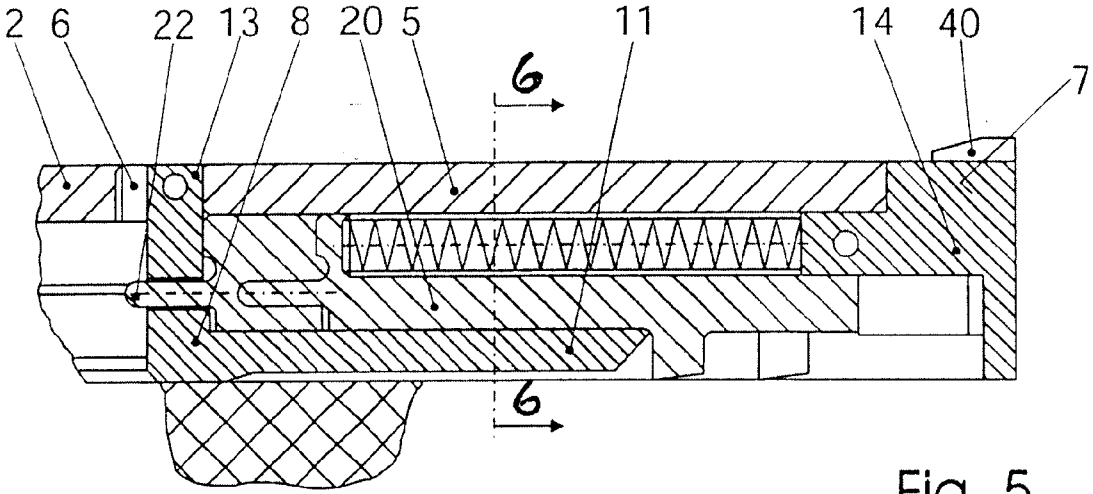
FIG. 5 shows a view as in FIG. 1, but in a further variant.
Figure 7:
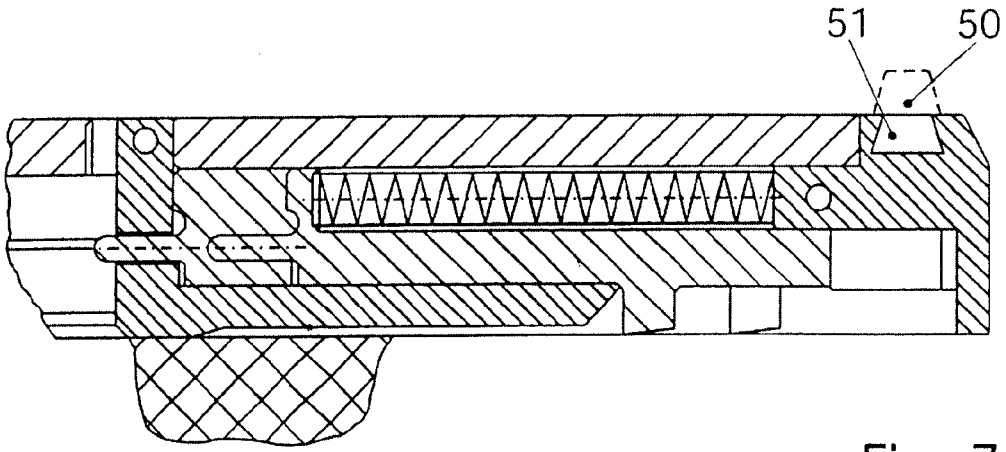
FIG. 7 shows a view as in FIG. 1, but in yet another variant.

In the variant shown in FIGS. 5 and 6, the rear wall 14 of the insert piece 8 is thickened in the longitudinal direction, and the cover wall 5 of the barrel slide 2 is correspondingly shortened. A rear sight is formed integrally with the upper part of the insert piece 8. As can be seen in FIG. 6, this is raised just above the silhouette of the barrel slide, that is to say it is very close to the barrel axis. In the variant shown in FIG. 7, a dovetail groove 50 is provided at the same point on the insert piece 8 for the insertion of a rear sight 51 (which is indicated by dashed lines).

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A pistol comprising a basic housing (1), a barrel slide (2) which is guided movably on the basic housing (1), the barrel slide comprises two side walls (3, 4) and a cover wall (5) in between the side walls which together define an interior space, the interior space of the barrel slide receives a barrel at the front and behind the barrel an insert piece (8) is mounted, the insert piece, contains a firing bolt and a firing spring, wherein a) the insert piece (8; 108) forms an internal cavity (15; 115) which is open on a side facing the cover wall (5; 105) of the barrel slide (2), guide surfaces (16, 17, 18; 116, 117, 118) are provided for the firing bolt (20; 120) on the internal cavity, b) the firing bolt (20; 120) has mating surfaces (26, 27, 28; 126, 127, 128) which rest on the guide surfaces (16, 17, 18; 116, 117, 118) of the internal cavity (15; 115) to define a free space (24; 121) which runs in a longitudinal direction between the firing bolt (20; 120) and the cover wall (5; 105) on the side facing the cover wall (5; 105) of the barrel slide (2), and c) the free space (24; 121) contains the firing spring (33) which has a front end (34) supported on the firing bolt (20; 120) and a rear end (35) supported on an opposing bearing (14).

2. The pistol as claimed in claim 1, wherein the free space (24) which contains the firing spring (33) is bounded by the side walls (9, 10) of the insert piece (8).

3. The pistol as claimed in claim 1, wherein the free space (124) has a longitudinal groove which is open at the top.

4. The pistol as claimed in claim 1, wherein the guide surfaces (16, 17, 18; 116, 117, 118) of the insert piece (8; 108) and the mating surfaces (26, 27, 28; 126, 127, 128) of the firing bolt (20; 120) form three sides of a rectangle.

5. The pistol as claimed in claim 1, wherein the rear wall (14) of the insert piece (8; 108) forms the opposing bearing for a rear end (35) of the firing spring (33), and rests on a rear end (7) of the barrel slide (2).

6. The pistol as claimed in claim 5, wherein the insert piece (8; 108) is connected to the barrel slide (2) at two points by connecting means, which pass through the entire width of the barrel slide (2).

7. The pistol as claimed in claim 6, wherein the connecting means comprises at least one pin.

8. The pistol as claimed in claim 7, wherein the pin (30) passes through the barrel slide (2) and passes through the rear wall (14) of the insert piece (8; 108) at a rear connection point.

9. The pistol as claimed in claim 5, wherein the rear wall (14) of the insert piece (8) has a transverse groove (50) for the insertion of a rear sight (51).

10. The pistol as claimed in claim 5, wherein a rear sight (40) is formed integrally on the rear wall (14) of the insert piece (8; 108).

* * * * *